US005313764A

United States Patent [19]

Kronseder

[11] Patent Number: 5,313,764

[45] Date of Patent: May 24, 1994

[54] PACKING APPARATUS

[76] Inventor: Hermann Kronseder, Regensburger Strasse 42, 8404 Woerth, Fed. Rep. of Germany

[21] Appl. No.: 938,222

[22] PCT Filed: Jul. 24, 1991

[86] PCT No.: PCT/EP91/01388

§ 371 Date: Oct. 23, 1992

§ 102(e) Date: Oct. 23, 1992

[87] PCT Pub. No.: WO92/02416

PCT Pub. Date: Feb. 20, 1992

[30] Foreign Application Priority Data

Jul. 31, 1990 [DE] Fed. Rep. of Germany ..... 4024335

[51] Int. Cl.[5] ..... B65B 21/18

[52] U.S. Cl. ..... 53/247; 53/251; 53/539

[58] Field of Search ..... 53/247, 251, 250, 249, 53/260, 255, 539, 543, 531

[56] References Cited

U.S. PATENT DOCUMENTS

| | | | |
|---|---|---|---|
| 2,771,202 | 0/1956 | Meyer | 214/309 |
| 3,631,651 | 1/1972 | Kopp | 53/247 X |
| 3,735,556 | 5/1973 | Dille et al. | 53/247 X |
| 3,929,234 | 12/1975 | Warren | 53/247 X |

FOREIGN PATENT DOCUMENTS

| | | |
|---|---|---|
| 0124854A3 | 11/1984 | European Pat. Off. . |
| 1290864 | 3/1969 | Fed. Rep. of Germany . |
| 2935045A1 | 3/1981 | Fed. Rep. of Germany . |
| 3420143C1 | 3/1986 | Fed. Rep. of Germany . |
| 3817830A1 | 11/1989 | Fed. Rep. of Germany . |
| 717444 | 10/1954 | United Kingdom . |

*Primary Examiner*—James F. Coan

*Attorney, Agent, or Firm*—Finnegan,Henderson, Farabow, Garrett & Dunner

[57] ABSTRACT

A packing apparatus used for filling or/and emptying bottle cases or the like. The packing apparatus comprises an extension arm, which is adapted to have attached thereto a gripping head and which is articulated on two articulation points with the aid of steering rods defining a steering rod system which is adapted to be moved after the fashion of the bars of a parallelogram, said extension arm being adapted to be moved in an essentially horizontal direction via a cam disk. The steering system also comprises a bipartite steering rod whose parts are adapted to be pivoted relative to each other. By pivoting the two parts of the steering rod relative to each other with the aid of a second cam disk and by changing thus the effective length of the steering rod defined by these two parts, an essentially vertical motion can be superimposed on the horizontal motion of the extension arm, to provide an appropriate path for the gripping head.

16 Claims, 5 Drawing Sheets

PACKING APPARATUS

BACKGROUND OF THE INVENTION

The present invention refers to a packing apparatus for filling or/and emptying bottle cases or the like, comprising an extension arm, which is adapted to have attached thereto a bottle gripping head and which is articulated on two articulation points with the aid of first and second steering means, which are each connected to a basic frame at an articulation point, thus defining a rod means which is adapted to be moved after the fashion of the bars of a parallelogram, the first one of the two steering means being provided with a cam element, and a horizontal control element being provided, which is rotatable about a shaft and constructed after the fashion of a cam disk with a guide path and on which the cam element is guided with movement of the rod means and with generation of an essentially horizontal motion of the suspension point for the gripping head when the horizontal control element is being rotated, and further comprising means for generating an essentially vertical motion of the suspension point, which is superimposed on said horizontal motion.

DE 34 20 143 C1 discloses a packing apparatus in the case of which an extension arm provided with a bottle gripping head is moved essentially horizontally via the bars of a parallelogram, said bars of a parallelogram being connected to a crank, which is driven by a motor, so that they can be moved via a pusher. For effecting a vertical movement of the gripping head, which is connected to the extension arm, a separate drive means is provided, which, just as the drive means for the bars of the parallelogram, comprises a motor with a crank and a pusher connecting the crank and the extension arm.

A packing apparatus of the type mentioned at the beginning is known from U.S. Pat. No. 2,771,202. In the case of this apparatus, a vertically movable suspension for a bottle gripping means is provided on the extension arm. The extension arm, which comprises two horizontally spaced legs, is provided with approximately vertically extending guide paths in which a transverse support means can be moved vertically, said transverse support means being arranged between said legs and being adapted to have attached thereto bottle gripping means. A vertical movement of the transverse support means is effected via a separate lifting rod system whose movement is again controlled via the horizontal control element under cooperation of a spring means.

The present invention is based on the task of providing a packing apparatus which is improved in comparison with this prior art.

SUMMARY OF THE INVENTION

In accordance with the present invention, this task is solved by the features that the second steering means comprises two steering members, which are adapted to be pivoted relative to each other about a joint, one of said two steering members including an additional cam element, and a vertical control element being provided, which is adapted to be rotated about a shaft and constructed after the fashion of a cam disk with a guide path an on which said additional cam element is guided with generation of the essentially vertical movement of the suspension point when the vertical control element is being rotated.

This solution according to the invention achieves, in comparison with the prior art, a much simpler structural design so that the packing apparatus according to the present invention can be produced with less outlay and is particularly suitable for smaller firms in which the packing capacities required are only comparatively small. Moreover, better installation conditions are obtained for the conveyor means of bottles and cases, since in the case of the apparatus according to the present invention, no space will be wasted for a separate lifting rod system guaranteeing a vertical movement of the suspension point.

In accordance with a preferred embodiment of the present invention, cam disks are provided as control elements, said cam disks being adapted to be rotated about a common shaft and interconnected for joint rotation, a cam disk with a guide groove being provided as horizontal control element and a cam disk whose outer rim is constructed as a guide path being provided as a vertical element. On the basis of these measures, a particularly compact structural design of the apparatus according to the present invention can be guaranteed.

A further advantageous embodiment of the present invention provides the features that the guide paths of the two control elements are each constructed as a closed path and that the control elements are adapted to be rotated continuously in one direction thus generating closed, recurring paths of the suspension point. The control elements can be produced such that they are adapted to the respective case of use so that paths of the type required by said cases of use, especially by the space conditions existing at the place in question, will be described.

In accordance with an additional advantageous further development of the present invention, the steering member, which forms part of the bipartite second steering means and which is connected to the basic frame, can be constructed as a plate, which has arranged thereon the additional cam element, preferably a roller, the articulation points and said cam element being arranged on said plate in correspondence with the corners of a rectangular triangle. Also these features contribute to the possibility of producing the apparatus according to the invention as a compact construction.

Finally, the apparatus according to the present invention can be provided with the expedient feature that a lateral bracket arm, which is adapted to have attached thereto a gripping head and which extends at right angles to the extension arm, is provided at the suspension point, at least on one side thereof. In this case, lines for supplying receptacles or cases can be provided, one one top of the other, at the side of the packing apparatus.

BRIEF DESCRIPTION OF THE DRAWINGS

The present invention will now be explained and described in detail on the basis of embodiments and on the basis of the drawings enclosed, which refer to these embodiments and in which.

DETAILED DESCRIPTION OF THE INVENTION

Figure 1:
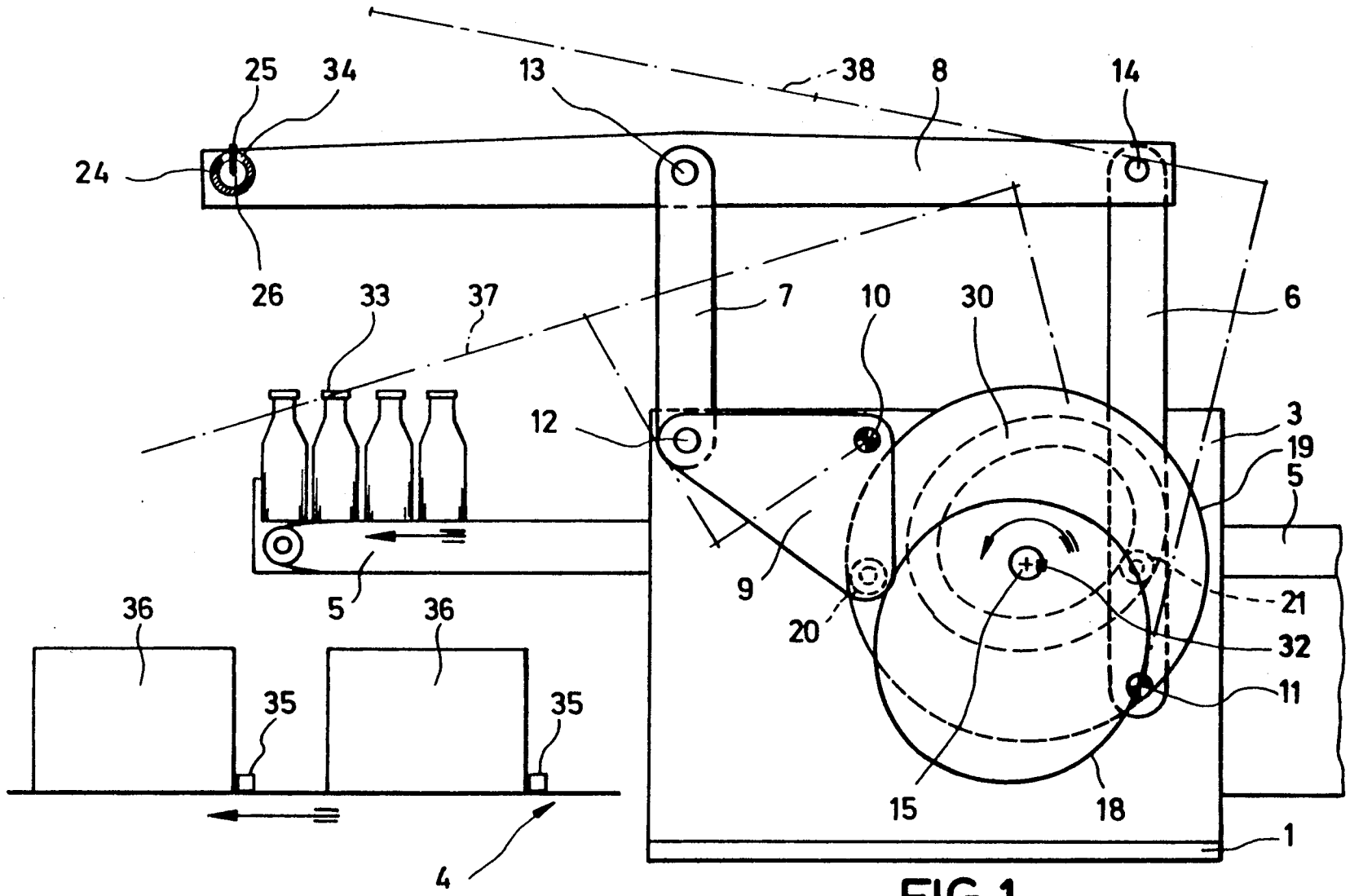
FIG. 1 shows a side view of an embodiment of a packing apparatus according to the present invention.
Figure 2:
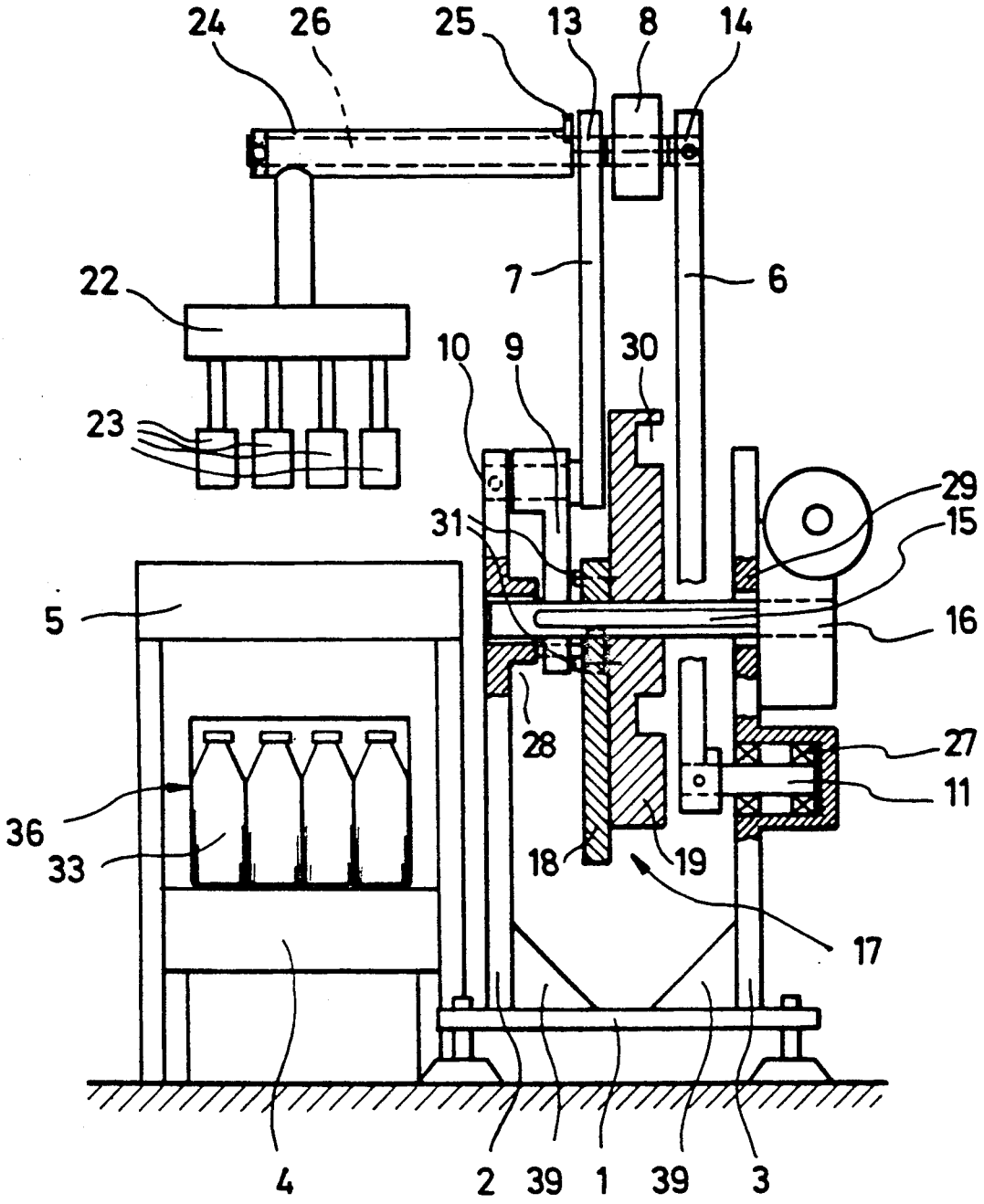
FIG. 2 shows a front view of the packing apparatus according to the present invention of FIG. 1.

In FIGS. 1 and 2, reference numeral 1 refers to a base plate having attached thereto side plates 2 and 3, which extend at right angles to said base plate, as well as triangular reinforcement plates 39, said base plate 1 forming together with said side plates or walls 2 and 3 as well as said reinforcement plates a basic frame. Reference numeral 6 refers to a steering rod, said steering rod 6 being, at one end thereof, rotatably supported in a bearing 27, which is provided in the side wall 3, via a laterally projecting axle stub 11, whereas the other end thereof is articulated on an extension arm 8 via a joint 14. An additional steering rod 7 is articulated on said extension arm 8 via a joint 13, said additional steering rod 7 being connected via a joint 12 to a steering plate 9 at its end located opposite said joint 13. The steering plate 9 is rotatably supported in a bearing 10 provided in the side plate 2. Reference numereral 20 refers to a cam element, which is provided on said steering plate and which, in the case of the present embodiment, consists of a roller abutting on the outer rim of a cam disk 18, said outer rim being constructed as a cam rim. The cam disk is connected to a rotary shaft 15, which is supported in bearings 28 and 29 in the side walls 2 and 3, respectively, and which is driven via a motor-transmission unit 16 schematically outlined in FIG. 2. The rotary shaft 15 has connected thereto an additional cam disk 19, which has provided therein a closed cam groove 30. A cam element 21, which is connected to the steering rod 6 and which—just as the cam element 20 of the present embodiment—is constructed as a cam roller, projects into said cam groove 30. As can be seen from FIG. 2, both cam disks 18 and 19 are arranged on said rotary shaft 15 such that they abut one another and they are interconnected by a screw means 31. Said cam disk 18 and said cam disk 19, which is connected thereto, are secured against rotation relative to the rotary shaft 15 by means of a key element 32.

Reference numeral 26 refers to a support rod, which projects laterally from the extension arm 8 and onto which a support tube 24 has been pushed, said support tube 24 being used for a gripping head 22 (which is not shown in FIG. 1). The gripping head 22, which is adapted to be pivoted about the support rod 26, is provided with a number of gripping elements 23 for taking hold of bottles by the neck. At its end facing the extension arm 8, the support tube 24 is provided with a radially extending opening 34 through which stop means for striking against a pin 25 are formed for the purpose of limiting pivotal movement of said gripping head.

Reference numeral 4 refers to a conveyor means for conveying bottle cases 36. In the case of the present embodiment, a bottle conveying line 5 equipped with a conveying belt is arranged above the case conveyor means 4, said bottle conveying line 5 ending below the support tube 24 of the extension arm 8 and within the horizontal pivoting range thereof. Reference numeral 35 refers to drivers, which are provided on the case conveyor means 4 and by means of which the cases 36 are moved, said drivers guaranteeing an exact alignment of said cases 36 on said case conveyor means 4.

The apparatus shown in FIGS. 1 and 2 can be used for filling the cases 36 with bottles as well as for removing bottles from said cases. By rotating the shaft 15 in one direction of rotation, the steering rod 6 will be pivoted about its axle stub 11 via the cam element 21 guided in the cam groove 30, whereby the rod means, which is formed by the steering rods 6, 7 and plate 9 and which, in principle, corresponds to the bars of a parallelogram, will be moved and an essentially horizontal to-and-fro motion of the extension arm 8 in accordance with the cam groove 30 will be achieved. Due to the fact that the cam roller 20 of the steering plate 9 is guided on the outer cam rim, or rather rolls on said rim, an essentially vertical motion component of the gripping head suspension point is additionally provided. In accordance with the curved path provided, the steering plate 9 is pivoted about the bearing 10, whereby the angle between the steering rod 7 and the steering plate 9 and, consequently, the effective length of the steering means defined by said steering rod 7 and said steering plate 9 will change. In the course of one complete rotation of the cam disks 18 and 19, the gripping head suspension point will describe a closed path, which, in the case of additional rotations of the cam disks in the same direction of rotation, will be repeated cyclically in the same manner. The extreme positions of the extension arm 8 occurring are indicated by the dot-and-dash lines 37 and 38 in FIG. 1. According to line 37, the extension arm will occupy approximately a position in which the gripping head can take hold of bottles stored in a case 36 for emptying said case, or put down bottles in said case. In the vicinity of the position marked by line 38, bottles positioned on the bottle conveyor 5 can be picked up, or they can be put down on said bottle conveyor. By coordinating the supply of cases and bottles as well as the cyclic movement of the suspension point of the extension arm with regard to space and time, a continuous packing or unloading operation can be maintained.

In the case of the embodiment shown in FIGS. 1 and 2, it will suffice to use a cam disk with a cam rim as a guide path for the cam element 20 of the steering plate 9, since, due to the weight of the extension arm and of the load attached thereto, it is guaranteed that the cam roller 20 will remain on the cam rim of the cam disk 18. For the cam element 21, however, a cam disk including a guide groove has to be provided, the groove edges effecting guidance of the cam element alternately. However, when the extension arm is sufficiently long, a moment will occur by means of which the cam roller 21 is continuously forced against the inner edge of the guide groove so that, in this case, it would just as well be possible to use a cam disk which corresponds to the cam disk 19 and which only has an outer rim used as a guide path.

Depending on the geometric conditions at the place of use, which are given by the way in which the conveying lines are positioned relative to one another, by the dimensions of the bottles and cases as well as by the possible mode of arrangement of the packing apparatus relative to the conveying lines and by other factors, cam disks can be produced on the basis of which a path for the gripping head is obtained, which is adapted to these geometric conditions in the best possible manner. In addition to such adaptation to the geometric conditions, it is also possible to take care—by providing the cam disk guide paths with adequate dimensions —that, on the basis of cycle times which are as short as possible, the acceleration and deceleration values occurring correspond to the requirements determined by the goods to be packed. In this connection, variable speeds of rotation for the cam disks may be advantageous as well.

FIGS. 3 to 6 show schematic representations of additional embodiments of packing apparatuses. Identical parts or parts producing the same effect have been provided with the same reference numerals as in the case of FIGS. 1 and 2: the reference numerals are, however, provided with the indices a to d.

Figure 3:
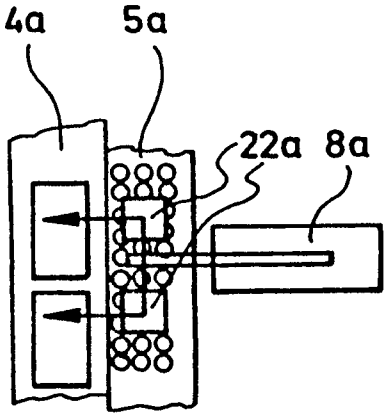
FIG. 3 shows a top view (schematic) of an additional embodiment of a packing apparatus according to the present invention in a first case of use.
Figure 3A:
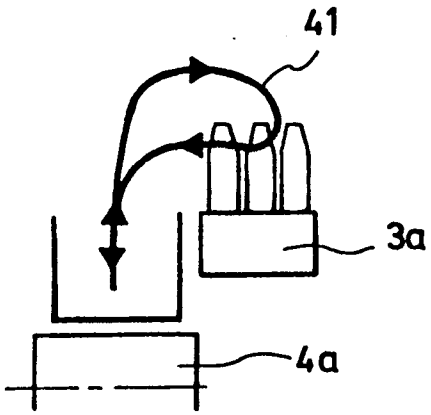
FIG. 3A shows the path described by the gripping head in connection with the case of use according to FIG. 3.

In the case of the embodiment of FIG. 3, two packing heads 22*a* are attached to one extension arm 8*a*, and, as can especially be seen from FIG. 3*a*, the bottle conveyor 5*a* is arranged above the case conveyor and between said case conveyor and the packing apparatus such that it is laterally displaced relative to said case conveyor 4*a*. The extension arm 8*a* carries out a movement in a plane which extends at right angles to the conveying lines 4*a* and 5*a*. The packing apparatus includes cam disks guaranteeing a closed path which corresponds to curve 41 of FIG. 3*a*.

Figure 4:
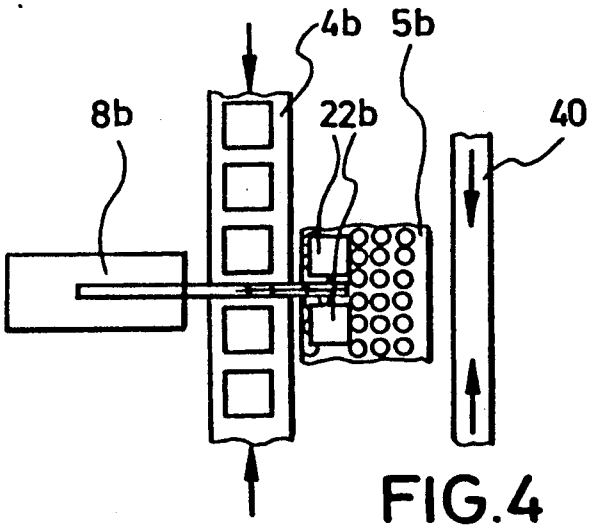
FIG. 4 shows a top view (schematic) of the embodiment of a packing apparatus according to the present invention of FIG. 3 in a second case of use.
Figure 4A:
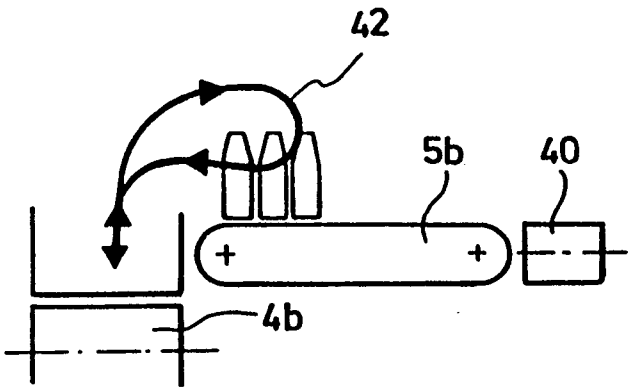
FIG. 4A shows the path described by the gripping head in connection with the case of use according to FIG. 4.

Also in the case of the embodiment shown in FIG. 4, two gripping heads 22*b* are provided, which move, in accordance with path 42 of FIG. 4*a*, in a plane extending at right angles to the direction of movement of a case conveyor 4*b*. The case conveyor 4*b* is arranged between the packing apparatus and a bottle conveyor means 5*b* conveying the bottles at right angles to the direction of movement of the case conveyor. The bottle conveying belt 5*b* is charged via a bottle conveyor means 40 whose direction of movement is parallel to that of the case conveyor. In view of the fact that, in the case of the present embodiment, the bottle conveyor is arranged only a short distance above the belt conveyor, the path provided for the gripping heads can be less steep than that provided in the case of the embodiment according to FIGS. 3 and 3*a*.

Figure 5:
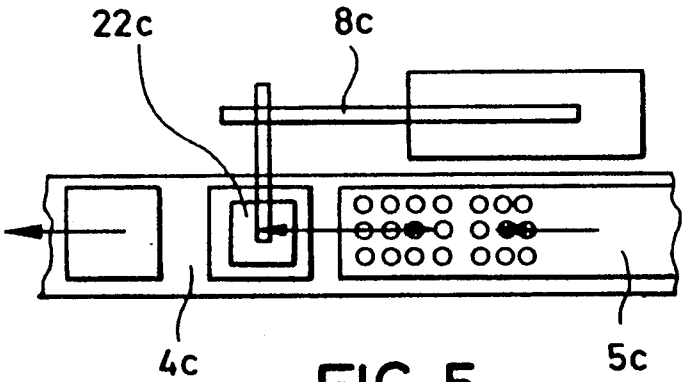
FIG. 5 shows a top view (schematic) of the embodiment of a packing apparatus according to the present invention of FIGS. 1 and 2.
Figure 5A:
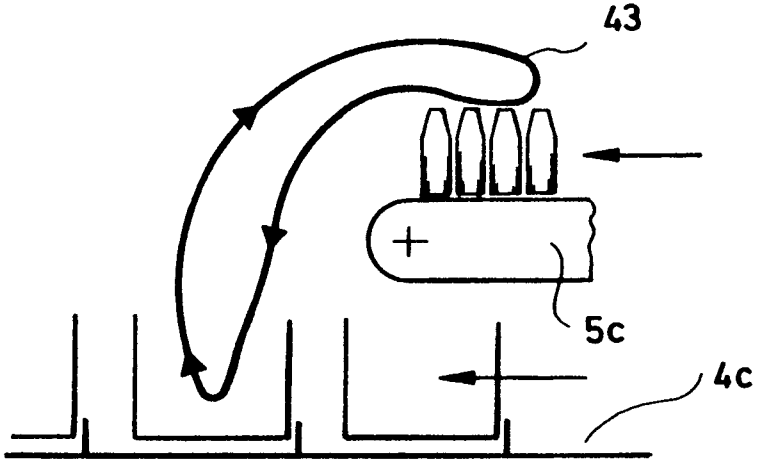
FIG. 5A shows the path described by the gripping head in the case of the embodiment according to FIG. 5.

The packing apparatus shown in FIG. 5 corresponds to the packing apparatus according to FIGS. 1 and 2. An extension arm 8*c* has laterally attached thereto a single gripping head 22*c*, and the movement of said gripping head 22*c* takes place in a plane along the conveying lines 4*c* and 5*c* for the cases and bottles, respectively, said conveying lines being arranged one above the other, as has also been shown in FIGS. 1 and 2. In view of the fact that the bottle conveyor is arranged far above the case conveyor, a closed path having a large vertical component, which corresponds to curve 43 of FIG. 5*a*, is provided.

Figure 6:
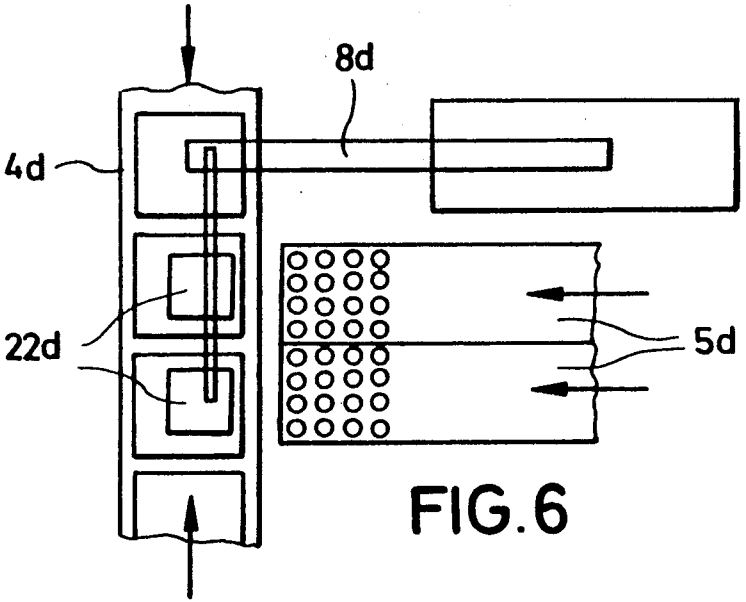
FIG. 6 shows a top view (schematic) of an additional embodiment of a packing apparatus according to the present invention.
Figure 6A:
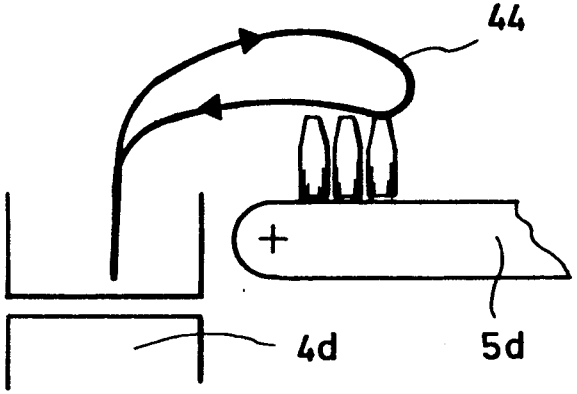
FIG. 6A shows the path described by the gripping head in the case of the embodiment according to FIG. 6.

In the case of the embodiment of FIG. 6, two gripping heads 22*d* are arranged on one side of an extension arm 8*d*. The gripping heads move in a plane extending at right angles to the direction of transport of the cases. In correspondence with the two gripping heads provided, a bottle conveyor 5*d* is provided, which is constructed such that it can simultaneously charge both gripping heads, the bottles being transported perpendicularly to the direction of movement of the cases. It follows that the packing apparatus according to FIG. 6 can be used for simultaneously charging or emptying two cases, the cam disks of the apparatus being constructed for a path according to path 44 of FIG. 6*a*.

Figure 7:
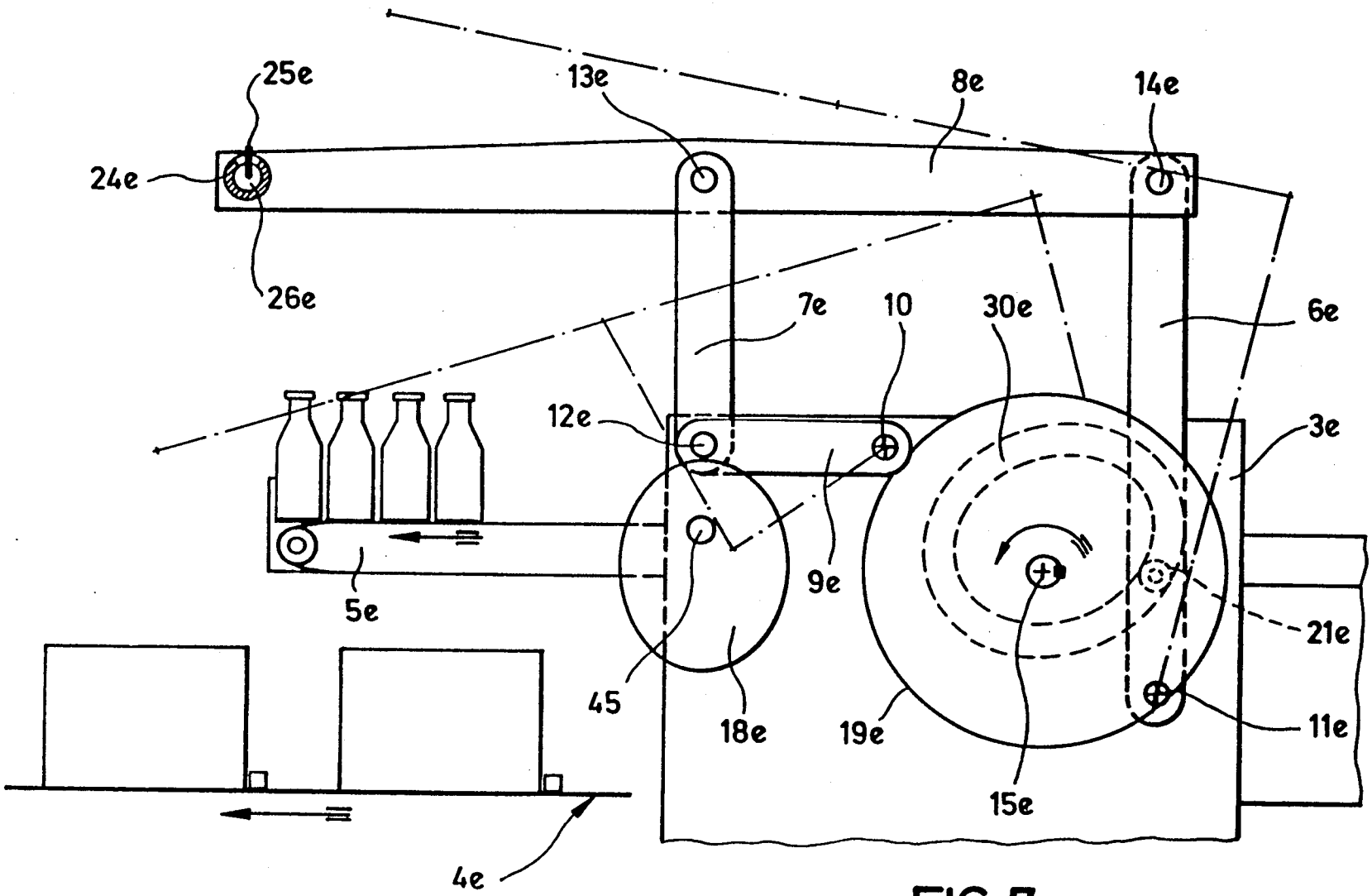
FIG. 7 shows an additional embodiment of a packing apparatus according to the present invention with separate horizontal and vertical control elements.

In the case of the embodiment shown in FIG. 7, identical parts or parts producing the same effect have been provided with the same reference numerals as in the case of FIGS. 1 and 2; the reference numerals are, however, provided with the index e.

The embodiment of FIG. 7 differs from the embodiment shown in FIGS. 1 and 2 with regard to the fact that two cam disks 18*e* and 19*e*, which are separated from each other, are provided. The cam disk 18*e* is arranged such that it is displaced relative to the cam disc 19*e*, and it is adapted to be rotated about a separate rotary shaft 45, which is supported in the side wall 3*e*. The cam disc 18*e* is stopped by a cam element, which is formed by an extended hinge pin of the joint 12*e*. The shafts 45 and 15*e*, respectively, can be rotated at the same rotational speed, but different rotational speeds can be used as well.

In the case of the embodiment of FIG. 7, an essentially vertical motion component of the suspension point is produced by changing, with the aid of the cam disk 18*e*, the angle between the steering rods 7*e* and 9*e* and, consequently, the effective length of the steering means defined by these two steering rods. The essentially vertical movement of the suspension point, which is produced by the cam disk 18*e*, is superimposed by an essentially horizontal movement, which is produced by the separate rotation of the cam disk 19*e*. By means of the cam disks, which are separated from each other and which are adapted to be rotated independently of each other—also at different speeds—closed as well as non-closed paths for the gripping heads can be generated.

In the case of all the embodiments shown hereinbefore, the cam disks can be rotated not only in one direction but also in varying directions, rotations of less than 360° being, in this connection, imaginable as well.

The present invention provides a packing apparatus which can be used advantageously especially in cases in which the packing capacities required are only comparatively small. The apparatus can be adapted to a plurality of cases of use by producing cam disks which are specifically suitable for the respective application and by means of which paths of the gripping heads can be produced, which are adapted in the best possible way to the respective conditions at the place of use, especially to the geometric conditions, so that, with due regard to the maximum possible acceleration and deceleration values, short cycle times can be achieved.

The purely mechanical control via cam disks is less susceptible to trouble than an electronic control, and, consequently, the apparatus according to the present invention can be used advantageously in particular under extreme operating conditions. The fact that, in comparison with electronic control means, the present control can be adapted less easily can hardly be regarded as being disadvantageous, since operative adaptations at the place of use are required only in very rare cases. If necessary, the user may keep a set of cam disks at hand, so as to be actually able to carry out such operative adaptations. By means of the purely mechanical drive of the extension arm, it will be possible to achieve smoother acceleration and deceleration curves and, consequently, a less jerky mode of operation than in the case of e.g. a hydraulic drive.

As can be seen from FIG. 7, the cam disk 18*e* can be arranged separately from the cam disk 19*e*, the vertical steering rod 7*e* being operatively connected to the cam disk 18*e* and the extension arm 8*e*. The vertical steering rod 7*e* can be guided either by a pivotal steering rod 9*e* or by a line guide means, the steering rod 7*e* being, in the latter case, operatively connected to the extension arm 8*e* via a longitudinal slot provided in said extension arm.

In the case of the example shown in FIG. 2, an extremely narrow construction is achieved due to the fact that the two steering rods 6 and 7 are arranged on the extension arm 8 in opposed relationship with each other in such a way that the steering rod 7 is located approximately in the plane of the cam disk 18 and the extension arm 8 is located approximately in the plane of the cam disk 19. In the case of this example, the two cam disks 18 and 19 are supported on a common shaft 15 so that they can easily be replaced by a different pair of cam disks by drawing out said shaft 15.

I claim:

1. Apparatus for crating or uncrating a group of bottles with respect to cases adapted to hold a group of the bottles comprising a frame, an extension arm extending in a generally horizontal direction, a gripping head comprising a plurality of gripping elements for simultaneously gripping a group of bottles suspended from a free end of said extension arm, a first steering rod pivotally mounted at one end about a horizontal axis to the frame and pivotally connected at its opposite end at a first pivot point to the extension arm remote from its free end, a first rotary cam means for pivoting said first steering rod about its axis and cause essentially horizontal motion of said extension arm and gripping head, a second steering rod comprising two steering members pivotally connected at one end thereof relative to each other, with the opposite end of a second one of said members being pivotally connected to the extension arm at a second pivot point and the opposite end of a first one of said members being pivotally mounted about a horizontal axis to the frame and second rotary cam means for pivoting said first steering member of said second steering rod about its axis as said first steering rod is being pivoted about its axis for thereby simultaneously causing essentially vertical motion of said second steering member and of said extension arm and gripping head.

2. The apparatus of claim 1, wherein said first rotary cam means comprises a first cam wheel having a first guide path rotatable about a horizontal axis, a first cam follower mounted on said first steering rod engaged with said first guide path and means for rotating said first cam wheel and said second rotary cam means comprises a second cam wheel having a second guide path rotatable about a horizontal axis, a second cam follower mounted on first steering member of said second steering rod engaged with said second guide path and means for rotating said second cam wheel.

3. The apparatus of claim 2, wherein the first and second cam wheels rotate about a common axis.

4. The apparatus of claim 3, wherein the wheels are interconnected for joint rotation.

5. The apparatus of claim 2, wherein the first guide path on the first cam wheel is a guide groove in a side of the wheel.

6. The apparatus of claim 2, wherein the second guide path on the second cam wheel is a cam surface on an outer rim of the wheel.

7. The apparatus of claim 2, wherein at least one of the two guide paths of the cam wheels is constructed as a closed path.

8. The apparatus of claim 7, wherein both guide paths are closed, the cam wheels being adapted to be rotated continuously in one direction thus generating closed, recurring paths of motion for the gripping head.

9. The apparatus of claim 2, wherein in an approximately horizontal position of the extension arm, the two steering members of the second steering rod form an approximately 90° angle relative to each other.

10. The apparatus of claim 2, wherein the first steering member of the second steering rod is a plate, the second cam follower being located on the plate spaced from a line that passes through the point where the plate is pivotally connected to the frame and the point where the plate is pivotally connected to the second steering member of the second steering rod.

11. The apparatus of claim 10, wherein the pivot points and the second cam follower are arranged on said plate at the corners of a right triangle.

12. The apparatus of claim 1, wherein the second pivot point of the second steering rod on the extension arm is between the free end and the first pivot point of the first steering rod on the extension arm.

13. The apparatus of claim 2, wherein the first and second cam followers are rollers.

14. The apparatus of claim 1, including a bracket arm pivotally mounted to and extending essentially at right angles from one side of the free end of the extension arm, said gripping head being mounted on said bracket arm.

15. The apparatus of claim 2, wherein the second cam wheel for causing vertical motion of the extension arm is separate from the first cam wheel for causing horizontal motion of said extension arm and the second cam follower of the second steering rod engaged with the second guide path of said second cam wheel is located at the pivotal connection between said two steering members of said second steering rod.

16. The apparatus of claim 2, wherein the extension arm is located approximately in the same vertical plane as the first cam wheel and the second steering rod is located approximately in the same vertical plane as the second cam wheel.

* * * * *